US006211136B1

(12) United States Patent
Richter et al.

(10) Patent No.: US 6,211,136 B1
(45) Date of Patent: Apr. 3, 2001

(54) PROCESS FOR PREPARING GRANULAR DETERGENT COMPONENTS

(75) Inventors: Bernd Richter, Leichlingen; Hans-Josef Beujean, Dormagen; Wolfgang Seiter, Neuss, all of (DE)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 0 days.

(21) Appl. No.: 09/242,842

(22) PCT Filed: Aug. 23, 1997

(86) PCT No.: PCT/EP97/04606

§ 371 Date: Feb. 24, 1999

§ 102(e) Date: Feb. 24, 1999

(87) PCT Pub. No.: WO98/08929

PCT Pub. Date: Mar. 5, 1998

(30) Foreign Application Priority Data

Aug. 31, 1996 (DE) ..... 196 35 405

(51) Int. Cl.[7] ..... C11D 11/00

(52) U.S. Cl. ..... 510/441; 510/444; 510/299; 510/400; 510/466; 510/501; 510/509; 510/511

(58) Field of Search ..... 510/444, 441, 510/400, 466, 299, 501, 509, 511

(56) References Cited

U.S. PATENT DOCUMENTS

| | | | | |
|---|---|---|---|---|
| 4,323,312 | * | 4/1982 | Glatt et al. | 366/102 |
| 4,406,817 | * | 9/1983 | Muller et al. | 516/117 |
| 4,832,866 | * | 5/1989 | Schulz et al. | 516/120 |
| 5,143,662 | * | 9/1992 | Chesterfield et al. | 264/8 |
| 5,254,283 | * | 10/1993 | Arnold et al. | 510/530 |
| 5,258,133 | * | 11/1993 | Chapple | 510/375 |
| 5,300,317 | * | 4/1994 | Ivarson | 427/195 |
| 5,324,649 | * | 6/1994 | Arnold et al. | 435/187 |
| 5,804,544 | * | 9/1998 | Powell et al. | 510/347 |

FOREIGN PATENT DOCUMENTS

| | | | |
|---|---|---|---|
| 1450580 | * | 9/1976 | (EP) . |
| 0 253 567 | | 1/1988 | (EP) . |
| 0 272 033 | | 6/1988 | (EP) . |
| 0 274 907 | | 7/1988 | (EP) . |
| 0 357 280 | | 3/1990 | (EP) . |
| 0 486 592 | | 6/1994 | (EP) . |
| 91/06638 | * | 5/1991 | (WO) . |
| 93/07263 | * | 4/1993 | (WO) . |
| 95/32232 | | 11/1995 | (WO) . |

OTHER PUBLICATIONS

"Sandvik Rotocoat Process: Solvent–Free Coating and Agglomeration" Information Sheets provided by Sandvik Process Systems GmbH, Sep. 1993,3 pages.

Mackenzie and Mitchell:"Differential Thermal Analysis". A Review (Jun. 1962), vol. 87, pp. 420–434.

* cited by examiner

*Primary Examiner*—Lorna M. Douyon
(74) *Attorney, Agent, or Firm*—Wayne C. Jaeschke; Glenn E. J. Murphy

(57) ABSTRACT

A process for the production of pourable and free-flowing granular detergent composition components containing an active substance at least partly liquid at room temperature and a fine-particle carrier material for that active substance wherein the carrier material has a mean particle size of 3 $\mu$m to 0.5 mm by dropping the carrier material onto a rotating disk where it is radially accelerated by vanes arranged on the upper surface of said disk, and applying the liquid active substance to a stream of the carrier particles through an annular die formed by the outer edge of the rotating disk and a stator surrounding the disk.

18 Claims, No Drawings

PROCESS FOR PREPARING GRANULAR DETERGENT COMPONENTS

BACKGROUND OF THE INVENTION

1. Field of the Invention

This invention relates to a process for the production of pourable and free-flowing granular detergent ingredients which contain an active substance liquid at room temperature and a fine-particle carrier material for that active substance, and to the use of granules produced by this process for the production of solid detergents.

2. Discussion of Related Art

Modern detergents contain a number of ingredients which, besides those essential to the washing process, such as surfactants and builders, generally include other constituents which can come from such different groups of active substances as foam regulators, redeposition inhibitors, soil release agents, bleaching agents, bleach activators and dye transfer inhibitors. Besides this classification of active substances, typical detergent ingredients can also be classified according to their aggregate state at room temperature. Accordingly, a distinction may be drawn between solid and liquid ingredients of detergents. The percentage content of liquid ingredients in solid powder-form detergents should naturally not exceed a certain upper limit because otherwise the individual particles would cake together, the flowability of the detergent and its pourability from the box would no longer be guaranteed and the detergent would become far more difficult to dose and handle by the user. Accordingly, constituents liquid at room temperature are normally incorporated in powder-form detergents in the form of mixtures with solid absorbent carrier materials. Various processes are available for the production of such compounds of solid, powder-form carrier material and liquid active substance. For example, aqueous slurries of carrier material and liquid active substance can be spray-dried. This process is attended by difficulties where substances insoluble in water or not readily dispersible in water are to be processed. In addition, it is limited to substances which have a certain heat resistance and, in addition, has the disadvantage that removal of the water entails relatively high energy consumption. An alternative production process comprises, for example, applying liquids to particles of carrier material moved in a mixer. If the active substances involved are liquid at the temperature of the particulate carrier material, the carrier material to which the liquids are applied is in danger of agglomerating, which leads to a not always desirable increase in the size of the particles, and the particles are in danger of caking on the walls of the mixer. One way of avoiding these dangers is to use a fluidized bed of the carrier material to which the liquid is applied. In this case, however, it is important to bear in mind that a fluidized bed cannot be produced from every substance suitable for use as a solid carrier material and that, in many cases, the particles forming the fluidized bed cannot always be completely prevented from agglomerating.

The problem addressed by the present invention was to provide an alternative production process for granular detergent ingredients containing an active substance at least partly liquid at room temperature and a fine-particle carrier material in which these disadvantages would be avoided.

DESCRIPTION OF THE INVENTION

It has now surprisingly been found that this problem can be solved by using a spray coater which, hitherto, has been used in particular in the so-called Rotocoat® process, providing certain basic conditions are fulfilled in regard to the particle size of the carrier material to be sprayed.

The present invention relates to a process for the production of pourable and free-flowing granular detergent ingredients containing an active substance at least partly liquid at room temperature and a fine-particle carrier material for that active substance, characterized in that the carrier material, which has a mean particle size of 3 $\mu$m to 0.5 mm, is allowed to drop onto a rotating disk where it is radially accelerated by vanes arranged on the upper surface of the disk and in that the liquid active substance is applied to the stream of particles through an annular slot which is formed by the outer edge of the rotating disk and the stator surrounding the disk.

The invention advantageously makes use of the known measures of the Rotocoat® process used for processing completely different materials. The Rotocoat® process and the associated coater are described, for example, in an information sheet entitled "Sandvik Rotocoat® Process: Solvent-free Coating and Agglomeration" published by Sandvik Process Systems in September 1993. This process is a continuous coating process in which a powder-form carrier material drops down onto a horizontally mounted rotating disk. By means of vanes arranged on the upper surface of the disk, the powder is radially accelerated by the centrifugal force so that a particle stream is formed.

The liquid to be applied to the carrier material issues from an annular slot formed by the outer edge of the rotating disk and the stator surrounding the disk and impinges on the stream of particles flowing over the disk. The wetted particles are then taken up by an airstream by means of which they are discharged from the spray coater. Hitherto, this process—as described in the cited information sheet—was confined to the use of coating materials which are liquid at elevated temperatures and solid at room temperature. Coating materials such as these were used in heated, i.e. molten, form in the Rotocoat® process and, after impinging on the carrier material, solidified at the latest on entrainment by the cold airstream. In contrast to this known procedure, a substance which is both liquid at the processing temperature and at least partly liquid at room temperature or a mixture of such substances is used in the process according to the invention.

Accordingly, the present invention also relates to the use of a Rotocoat® coater for applying detergent ingredients at least partly liquid at room temperature to a fine-particle carrier material.

Quite high percentages of the material to be applied, for example not more than 80% by weight and, more particularly, up to 70% by weight, present in solid form at room temperature can be tolerated in the process according to the invention, particularly if the component solid at room temperature is present in liquid form at the processing temperature, i.e. on entry into the spray coater. In cases such as these, it is important to ensure that a homogeneous mixture of the component liquid at room temperature and the component solid at room temperature is used, for example in the form of a solution of one component in the other. If the component which is solid at room temperature does not dissolve completely, if at all, in the component liquid at room temperature, even after melting, as is the case for example with solid paraffins and liquid silicone oils, the mixture of molten component solid at room temperature and the component liquid at room temperature should be stirred until just before it enters the spray coater in order to achieve uniform application of the heterogeneous coating material to the carrier material. The use of solvents, i.e. more or less readily volatile substances which have to be removed by fairly intense heating after application of the coating material, is not preferred.

The nature of the particulate carrier material is not critical. Suitable particulate carrier materials are both inorganic detergent ingredients, such as alkali metal carbonates, alkali metal hydrogen carbonates, alkali metal sulfates, alkali metal phosphates, alkali metal silicates, zeolites (A, P and/or X), alkali metal perborates and/or alkali metal percarbonates, and organic materials, such as citric acid, alkali metal citrates and/or starch, and mixtures thereof. In the alkali metal salts mentioned, sodium is the preferred cation although the potassium and lithium salts may also be used. The mean particle size of the carrier material is preferably in the range from 3 μm to 100 μm and more preferably in the range from 30 μm to 100 μm. In one preferred embodiment of the process according to the invention, the carrier material contains no more than 15% by weight of particles smaller than 10 μm in size, 10% by weight to 50% by weight of particles between 10 μm and 50 μm in size, 30% by weight to 80% by weight of particles larger than 50 μm to 100 μm in size and 5% by weight to 30% by weight of particles larger than 100 μm in size. In another preferred embodiment, the carrier material contains 5% by weight to 20% by weight of particles smaller than 10 μm in size, 20% by weight to 40% by weight of particles between 10 μm and 50 μm in size, 20% by weight to 40% by weight of particles larger than 50 μm to 100 μm in size and 20% by weight to 50% by weight of particles larger than 100 μm in size. Extremely fine-particle substances, for example the detergent zeolites mentioned, may be agglomerated to particle sizes in the preferred range in known manner, for example by spray drying, before they are used in the process according to the invention. Since each individual particle is wetted by the process according to the invention, the mean particle size and the particle size distribution of the final granules normally do not differ significantly from those of the carrier material used. Carrier materials present in non-crystalline form are preferred.

According to the invention, up to 10% by weight, preferably 0.5% by weight to 7% by weight and more preferably 1% by weight to 4.5% by weight, based on the granular particles formed, of detergent ingredient liquid at room temperature can normally be applied without the granules sticking together, showing a tendency to form lumps or losing their flow properties.

The active substance liquid at room temperature to be applied to the carrier material is normally a surfactant, a soil release polymer, a foam-inhibiting paraffin oil or a foam-inhibiting silicone oil, for example a dimethyl polysiloxane. Mixtures of these active substances may also be used. The additives solid at room temperature, more particularly the foam inhibitors mentioned, may be selected from paraffin waxes, silicas—which may even be hydrophobicized in known manner—and bisamides derived from $C_{2-7}$ diamines and $C_{12-22}$ carboxylic acids.

The surfactants optionally used include in particular nonionic surfactants, such as alkyl glycosides and ethoxylation and/or propoxylation products of alkyl glycosides or linear or branched alcohols containing 12 to 18 carbon atoms in the alkyl moiety and 3 to 20 and preferably 4 to 10 alkyl ether groups. Corresponding ethoxylation and/or propoxylation products of N-alkylamines, vicinal diols, fatty acid esters and fatty acid amides, which correspond to the long-chain alcohol derivatives mentioned in regard to the alkyl moiety, and of alkylphenols containing 5 to 12 carbon atoms in the alkyl moiety may also be used. The only requirement is that they should not be completely solid at room temperature, but instead should be at least partly present in liquid form.

Known soil release polymers which may be used in accordance with the invention, providing they are at least partly present in liquid form at room temperature, are copolyesters containing dicarboxylic acid units, alkylene glycol units and polyalkylene glycol units. Soil release copolyesters of the type mentioned and their use in detergents have been known for some time. For example, DE-OS 16 17 141 describes a washing process using polyethylene terepththalate/polyoxyethylene glycol copolymers. DE-OS 22 00 911 relates to detergents containing nonionic surfactant and a copolymer of polyoxyethylene glycol and polyethylene terephthalate. DE-OS 22 53 063 describes acidic textile finishes which contain a copolymer of a dibasic carboxylic acid and an alkylene or cycloalkylene polyglycol and, optionally, an alkylene or cycloalkylene glycol. Polymers of ethylene terephthalate and polyethylene oxide terephthalate, in which the polyethylene glycol units have molecular weights of 750 to 5,000 and the molar ratio of ethylene terephthalate to polyethylene oxide terephthalate is 50:50 to 90:10, and their use in detergents is described in German patent DE 28 57 292. According to DE-OS 33 24 258, ethylene terephthalate/polyethylene oxide terephthalate polymers with molecular weights of 15,000 to 50,000, the polyethylene glycol units having molecular weights of 1,000 to 10,000 and the molar ratio of ethylene terephthalate to polyethylene oxide terephthalate being from 2:1 to 6:1, may be used in detergents. European patent EP 066 944 relates to textile treatment formulations which contain a copolyester of ethylene glycol, polyethylene glycol, aromatic dicarboxylic acid and sulfonated aromatic dicarboxylic acid in certain molar ratios. European patent EP 185 427 describes methyl-terminated or ethyl-terminated polyesters containing ethylene and/or propylene terephthalate and polyethylene oxide terephthalate units and detergents which contain such a soil release polymer. European patent EP 241 984 relates to a polyester which, besides oxyethylene groups and terephthalic acid units, also contains substituted ethylene units and glycerol units. European patent EP 241 985 discloses polyesters which, besides oxyethylene groups and terephthalic acid units, contain 1,2-propylene, 1,2-butylene and/or 3-methoxy-1,2-propylene groups and glycerol units and which are terminated by $C_{1-4}$ alkyl groups. European patent EP 253 567 relates to soil release polymers of ethylene terephthalate and polyethylene oxide terephthalate with a molecular weight of 900 to 9,000, the polyethylene glycol units having molecular weights of 300 to 3,000 and the molar ratio of ethylene terephthalate to polyethylene oxide terephthalate being 0.6 to 0.95. Polyesters at least partly terminated by $C_{1-4}$ alkyl or acyl groups and containing polypropylene terephthalate and polyoxyethylene terephthalate units are known from European patent application EP 272 033. European patent EP 274 907 describes sulfoethyl-terminated terephthalate-containing soil release polyesters. According to European patent application EP 357 280, soil release polyesters contain terephthalate, alkylene glycol and poly-$C_{2-4}$-glycol units are produced by sulfonation of unsaturated terminal groups. International patent application WO 95/32232 describes soil release polyesters with the general formula $X—(O—(CHR—)_a)_b[O—OC—Ph—CO—(O—(CHR—)_o)_p]_yO—Y$, in which a is a number of 2 to 8, b is a number of 1 to 300, o is a number of 2 to 8, p is a number of 1 to 300 and y is a number of 1 to 500, Ph is an o-, m- or p-phenylene group which may contain 1 to 4 substituents selected from $C_{1-22}$ alkyl groups, sulfonic acid groups, carboxyl groups and mixtures thereof, R is selected from hydrogen, a $C_{1-22}$ alkyl group and mixtures thereof and X and Y independently of one another are selected from hydrogen, alkyl and aryl monocarboxylic acid residues containing 5 to 32 carbon atoms, hydroxymonocarboxylic acid residues containing 2 to 22 carbon atoms and having a degree of oligomerization of 1 to 100 and dicarboxylic acid semiester residues of which the second carboxylic acid group is esterified with an alcohol $A—(OCHZCH_2)_d—OH$, where A is an alkyl or alkenyl group containing 8 to 22 carbon atoms, Z is hydrogen or an alkyl group containing 1 to 2 carbon atoms and d is a number of 1 to 40, with the proviso that X and Y cannot both be hydrogen if R is hydrogen or an alkyl group containing 1 carbon atom, a and/or o=2 and b and/or p=1.

Foam-inhibiting paraffin oils suitable for use in the process according to the invention, which may be present in the form of a mixture with paraffin waxes, are generally complex mixtures with no clear-cut melting point. They are normally characterized by determining their melting range by differential thermoanalysis (DTA), as described in "The Analyst" 87 (1962), 420, and/or their solidification point. This is understood to be the temperature at which the paraffin changes from the liquid to the solid state by gradual cooling. Paraffins containing less than 17 carbon atoms cannot be used for the purposes of the invention so that their percentage content in the paraffin oil mixture should be as small as possible and, preferably, is below the limit significantly measurable by standard analytical techniques, for example gas chromatography. Paraffins which solidify at 20° C. to 70° C. are preferably used. It is important in this regard to bear in mind the fact that even paraffin wax mixtures which appear solid at room temperature can contain varying proportions of liquid paraffin oils. In the paraffin waxes suitable for use in accordance with the invention, the liquid component at 40° C. is as large as possible without ever reaching 100% at that temperature. Preferred paraffin wax mixtures have a liquid component at 40° C. of at least 50% by weight and, more particularly, between 55% by weight and 80% by weight and a liquid component at 60° C. of at least 90% by weight. The result of this is that the paraffins are free-flowing and pumpable at temperatures down to at least 70° C. and preferably down to at least 60° C. In addition, it is important to bear in mind that the paraffins should not contain any volatile components. Preferred paraffin waxes contain less than 1% by weight and, more particularly, less than 0.5% by weight of components capable of evaporating at 110° C./normal pressure. Paraffins suitable for use in accordance with the invention can be obtained, for example, under the trade names of Lunaflex® from the Fuller company and Deawax® from DEA Mineral öl AG.

The paraffin oils may contain bisamides solid at room temperature which are derived from saturated fatty acids containing 12 to 22 and preferably 14 to 18 carbon atoms and from alkylenediamines containing 2 to 7 carbon atoms. Suitable fatty acids are lauric acid, myristic acid, stearic acid, arachic acid and behenic acid and the mixtures thereof obtainable from natural fats or hydrogenated oils, such as tallow or hydrogenated palm oil. Suitable diamines are, for example, ethylenediamine, 1,3-propylenediamine, tetramethylenediamine, pentamethylenediamine, hexamethylenediamine, p-phenylenediamine and toluylenediamine. Preferred diamines are ethylenediamine and hexamethylenediamine. Particularly preferred bisamides are bis-myristoyl ethylenediamine, bis-palmitoyl ethylenediamine, bis-stearoyl ethylenediamine and mixtures thereof and the corresponding derivatives of hexamethylenediamine.

Preferred embodiments of the invention include granules which contain sodium carbonate and/or sodium sulfate as their carrier material and a combination of paraffin oil with bisamide derived from $C_{2-7}$ diamines and $C_{12-22}$ carboxylic acids and/or a combination of silicone oil with hydrophobicized silica as the active substance at least partly liquid at room temperature. These granules normally have a greater foam-regulating effect than granules which contain the same ingredients in the same quantities, but which have been conventionally produced.

The granules produced by the process according to the invention are preferably used for the production of solid detergents, more especially particulate detergents. In its most simple form, this can be done by mixing with the other conventionally produced detergent ingredients which may be present either as individual substances or as multicomponent particles. The process known from European patent EP 486 592, which comprises an extrusion step, is preferably used for the production of detergents having high bulk densities, more especially in the range from 650 g/l to 950 g/l.

EXAMPLES

Example 1

Using a spray coater (MGL Mixer Granulator, manufacturer NICA Systems AB) with an external rotor diameter of 110 mm and a width of the annular slot of 0.6 mm, rotor speed 3,000 $min^{-1}$, free-flowing foam regulator granules with the composition shown in Table 1 below (% by weight) were produced by introducing the particulate carrier material shown from above and the liquid active substances also shown in Table 1 (throughput ca. 65 kg/h).

TABLE

Composition of the foam inhibitor granules [% by weight]

| | B1 | B2 | B3 | B4 | B5 | B6 |
|---|---|---|---|---|---|---|
| Sodium sulfate | 90 | 90 | 90 | — | — | — |
| Sodium carbonate | — | — | — | 90 | 90 | 90 |
| Polydimethyl siloxane[a)] | 10 | — | 3 | 10 | — | 3 |
| Paraffin[b)] | — | 10 | 7 | — | 10 | 7 |

[a)]Liquid at room temperature, containing ca. 1.5 to 2.0% by weight of hydrophobicized silica

[b)]Containing 12% by weight of bis-stearyl ethylenediamide; 10 to 20% by weight liquid at room temperature.

Example 2

Detergents were produced simply by mixing 1.5% by weight of foam regulator granules B2 with a standard heavy-duty detergent powder containing 21% by weight of zeolite NaA, 20% by weight of sodium sulfate, 3% by weight of sodium silicate, 10% by weight of sodium carbonate, 3.5% by weight of polymeric polycarboxylate (Sokalan® CP5), 8% by weight of sodium alkyl benzene sulfonate, 2% by weight of nonionic surfactant, 1.5% by weight of soap, 22% by weight of sodium perborate and 2% by weight of TAED, balance to 100% by weight water. It was shown by washing tests (Miele® W918 drum-type washing machine, 3.5 kg clean washing, water hardness 3° d, dosage 130 g detergent) that the foam regulators according to the invention are more effective, particularly at low temperatures, than a known foam regulator tested for comparison (C1) which had been produced by spray drying an aqueous slurry of its ingredients and which contained 10% by weight of the same bisamide-containing paraffin, 3% by weight of sodium carbonate, 58.7% by weight of sodium sulfate, 20% by weight of sodium silicate, 2% by weight of cellulose ether and water to 100% by weight. The foam scores shown in Table 2 below were obtained (scale of 0 to 6: 0=no foam; 3=bull's eye of washing machine half-filled with foam; 5=bull's eye of washing machine completely filled with foam; 6=loss of liquor through overfoaming; the values were read off after the specified washing time for the 40° C. program and in the specified temperature range for the 90° C. program). After storage (8 weeks in laminated boxes at 30° C./80% relative air humidity) of the detergent containing the foam regulator granules B2 according to the invention, there was no sign of any deterioration in the foam-regulating performance. The other foam regulator granules produced in accordance with Example 1 were not significantly different from B2.

TABLE 2

Foam scores of the foam regulators in the detergent

| Foam regulator | 40° C. | | | 90° C. | | |
|---|---|---|---|---|---|---|
| | <20 mins. | <40 mins. | >40 mins. | <55° C. | <75° C. | >75° C. |
| B2 | 0–1.5 | 0–1.5 | 0–1.5 | 0–1.5 | 0–1.5 | 2.0–3.5 |
| C1 | >4 | >4 | >4 | 2.0–3.5 | 0–15 | >4 |

What is claimed is:

1. A process for the production of pourable and free-flowing granular detergent composition containing an active substance at least partly liquid at room temperature and a fine-particle carrier material for the active substance, said carrier material having a mean particle size of 3 μm to 0.5 mm, comprising dropping said carrier material onto a rotating disk where it is radially accelerated by vanes arranged on the upper surface of said disk, and applying said liquid active substance to a stream of said carrier particles through an annular die formed by the outer edge of said rotating disk and a stator surrounding said disk, wherein said carrier material contains no more than 15% by weight of particles smaller than 10 μm in size, 10% to 50% by weight of particles between 10 μm and 50 μm in size, 30% by weight to 80% by weight of particles larger than 50 μm to 100 μm in size and 5% to 30% by weight of particles larger than 100 μm in size.

2. A process as in claim 1 wherein up to 80% by weight of said liquid active substance applied to said carrier particles is solid at room temperature.

3. A process as in claim 1 wherein the mean particle size of said carrier material is in the range from 3 μm to 100 μm.

4. A process as in claim 1 wherein up to 10% by weight of said active substance liquid at room temperature is applied to said carrier particles, based on the weight of the granular detergent composition produced.

5. A process as in claim 1 wherein said active substance liquid at room temperature which is to be applied to said carrier material is selected from the group consisting of a surfactant, a soil release polymer, a foam-inhibiting paraffin oil and a foam-inhibiting silicone oil.

6. A process as in claim 2 wherein said liquid active substance which is a solid at room temperature comprises a paraffin wax.

7. A process as in claim 2 wherein said liquid active substance to be applied to said carrier particles which is solid at room temperature is present in liquid form at the application temperature.

8. A process as in claim 2 wherein said liquid active substance which is solid at room temperature comprises silica, optionally hydrophobicized silica, and bisamides derived from $C_{2-7}$ diamines and $C_{12-22}$ carboxylic acids.

9. A process as in claim 1 wherein said carrier material comprises sodium carbonate or sodium sulfate, and said liquid active substance comprises a mixture of paraffin oil with bisamide derived from $C_{2-7}$ diamines and $C_{12-22}$ carboxylic acids or a mixture of silicone oil with hydrophobicized silica.

10. A process for the production of pourable and free-flowing granular detergent composition containing an active substance at least partly liquid at room temperature and a fine-particle carrier material for the active substance, said carrier material having a mean particle size of 3 μm to 0.5 mm, comprising dropping said carrier material onto a rotating disk where it is radially accelerated by vanes arranged on the upper surface of said disk, and applying said liquid active substance to a stream of said carrier particles through an annular die formed by the outer edge of said rotating disk and a stator surrounding said disk, wherein said carrier material contains 5% to 20% by weight of particles smaller than 10 μm in size, 20% to 40% by weight of particles between 10 μm and 50 μm in size, 20% to 40% by weight of particles larger than 50 μm to 100 μm in size and 20% by weight to 50% by weight of particles larger than 100 μm in size.

11. A process as in claim 10 wherein up to 80% by weight of said liquid active substance applied to said carrier particles is solid at room temperature.

12. A process as in claim 10 wherein the mean particle size of said carrier material is in the range from 3 μm to 100 μm.

13. A process as in claim 10 wherein up to 10% by weight of said active substance liquid at room temperature is applied to said carrier particles, based on the weight of the granular detergent composition produced.

14. A process as in claim 10 wherein said active substance liquid at room temperature which is to be applied to said carrier material is selected from the group consisting of a surfactant, a soil release polymer, a foam-inhibiting paraffin oil and a foam-inhibiting silicone oil.

15. A process as in claim 11 wherein said liquid active substance which is a solid at room temperature comprises a paraffin wax.

16. A process as in claim 11 wherein said liquid active substance to be applied to said carrier particles which is solid at room temperature is present in liquid form at the application temperature.

17. A process as in claim 11 wherein said liquid active substance which is solid at room temperature comprises silica, optionally hydrophobicized silica, and bisamides derived from $C_{2-7}$ diamines and $C_{12-22}$ carboxylic acids.

18. A process as in claim 10 wherein said carrier material comprises sodium carbonate or sodium sulfate, and said liquid active substance comprises a mixture of paraffin oil with bisamide derived from $C_{2-7}$ diamines and $C_{12-22}$ carboxylic acids or a mixture of silicone oil with hydrophobicized silica.

* * * * *